US008031220B2

(12) United States Patent
Nakahata

(10) Patent No.: US 8,031,220 B2
(45) Date of Patent: Oct. 4, 2011

(54) IMAGE FORMING APPARATUS

(75) Inventor: Hiroshi Nakahata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 509 days.

(21) Appl. No.: 12/327,539

(22) Filed: Dec. 3, 2008

(65) Prior Publication Data

US 2009/0142084 A1 Jun. 4, 2009

(30) Foreign Application Priority Data

Dec. 4, 2007 (JP) ..... 2007-313946

(51) Int. Cl.
*B41J 2/44* (2006.01)
*G03G 15/043* (2006.01)

(52) U.S. Cl. ..... 347/249

(58) Field of Classification Search ..... 347/232, 347/233, 234, 235, 248, 249
See application file for complete search history.

(56) References Cited

U.S. PATENT DOCUMENTS

2006/0132880 A1 6/2006 Amada et al.

FOREIGN PATENT DOCUMENTS

| | | |
|---|---|---|
| JP | 2004-170755 | 6/2004 |
| JP | 2004-333994 | * 11/2004 |
| JP | 2006-184526 | 7/2006 |

* cited by examiner

*Primary Examiner* — Huan Tran

(74) *Attorney, Agent, or Firm* — Canon USA Inc IP Division

(57) ABSTRACT

An image forming apparatus includes an image bearing member configured to bear an image, an exposure unit configured to draw a scanning line on the image bearing member by exposing the image bearing member according to image data, and at least two detection units configured to detect an amount of deviation in exposing position due to the exposure unit. The image forming apparatus further includes a drive unit configured to drive an optical part located on an optical path extending from the exposure unit to the image bearing member to reduce the amount of deviation, a measurement unit configured to measure an amount of driving of the drive unit, an estimation unit configured to estimate a residual amount of deviation, and a modulation unit configured to modulate a writing frequency in the exposure unit based on the measured amount of driving to reduce the estimated residual amount of deviation.

8 Claims, 15 Drawing Sheets

IMAGE FORMING APPARATUS

BACKGROUND OF THE INVENTION

1. Field of the Invention

The present invention relates to an image forming apparatus capable of, according to an electrophotographic method, capable of forming an electrostatic latent image with a laser beam scanning on the photosensitive drum, and developing a visible image on a recording medium by applying toner to the electrostatic latent image.

2. Description of the Related Art

An electrophotographic image forming apparatus forms an electrostatic latent image on a photosensitive member by exposing the photosensitive member with a light flux output from an exposure device. In particular, it is desirable that scanning lines (the moving locus of a light flux) on the photosensitive member should be straight with no inclination. If the exposing position deviates from an ideal position, causing the scanning lines to be inclined or curved, the image quality will deteriorate. In the case of an image forming apparatus that forms multicolor images by using toners of different colors, if scanning lines on respective image bearing members have different amounts of deviation, so-called color misregistration becomes visually noticeable.

In Japanese Patent Application Laid-Open No. 2004-170755, such a method is discussed as adjusting timing for writing scanning lines and adjusting the amount of exposure by measuring inclinations and curvatures of the scanning lines for each image height (the main scanning position) by using a number of registration detecting sensors arranged along the main scanning direction (along the axial direction of the photosensitive drum).

The prior art described above is fairly effective in improving color misregistration. However, if the inclination of the scanning line, which is one of the causes for color misregistration, is corrected, partial magnification of a scanning line changes. Therefore, it becomes necessary to correct the partial magnifications by forming a registration pattern again. When this correction process is executed, the image forming process is interrupted. Therefore, if the correction process is executed repeatedly, downtime, in which images cannot be formed, increases.

Furthermore, in the prior art, to correct the partial magnification with high accuracy, it is required to install the sensors in at least three positions along the main scanning direction. In that case, not only the number of components to be built in but also the number of patterns to be formed and the amount of signal processing to be executed will increase.

SUMMARY OF THE INVENTION

The present invention is directed to an image forming apparatus capable of maintaining high image quality while reducing the number of sensors, the number of registration patterns, the amount of signal processing, and downtime.

According to an aspect of the present invention, an image forming apparatus includes an image bearing member configured to bear an image, an exposure unit configured to draw a scanning line on the image bearing member by exposing the image bearing member according to image data, at least two detection units configured to detect an amount of deviation in exposing position due to the exposure unit, a drive unit configured to drive an optical part located on an optical path extending from the exposure unit to the image bearing member to reduce the amount of deviation detected by the detection units, a measurement unit configured to measure an amount of driving of the drive unit, an estimation unit configured to estimate a residual amount of deviation based on the amount of driving measured by the measurement unit, and a modulation unit configured to modulate a frequency of an image clock in the exposure unit to reduce the estimated residual amount of deviation.

According to an exemplary embodiment of the present invention, an image forming apparatus can maintain high image quality while reducing the number of sensors, the number of registration patterns, amount of signal processing, and downtime.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

Figure 1:
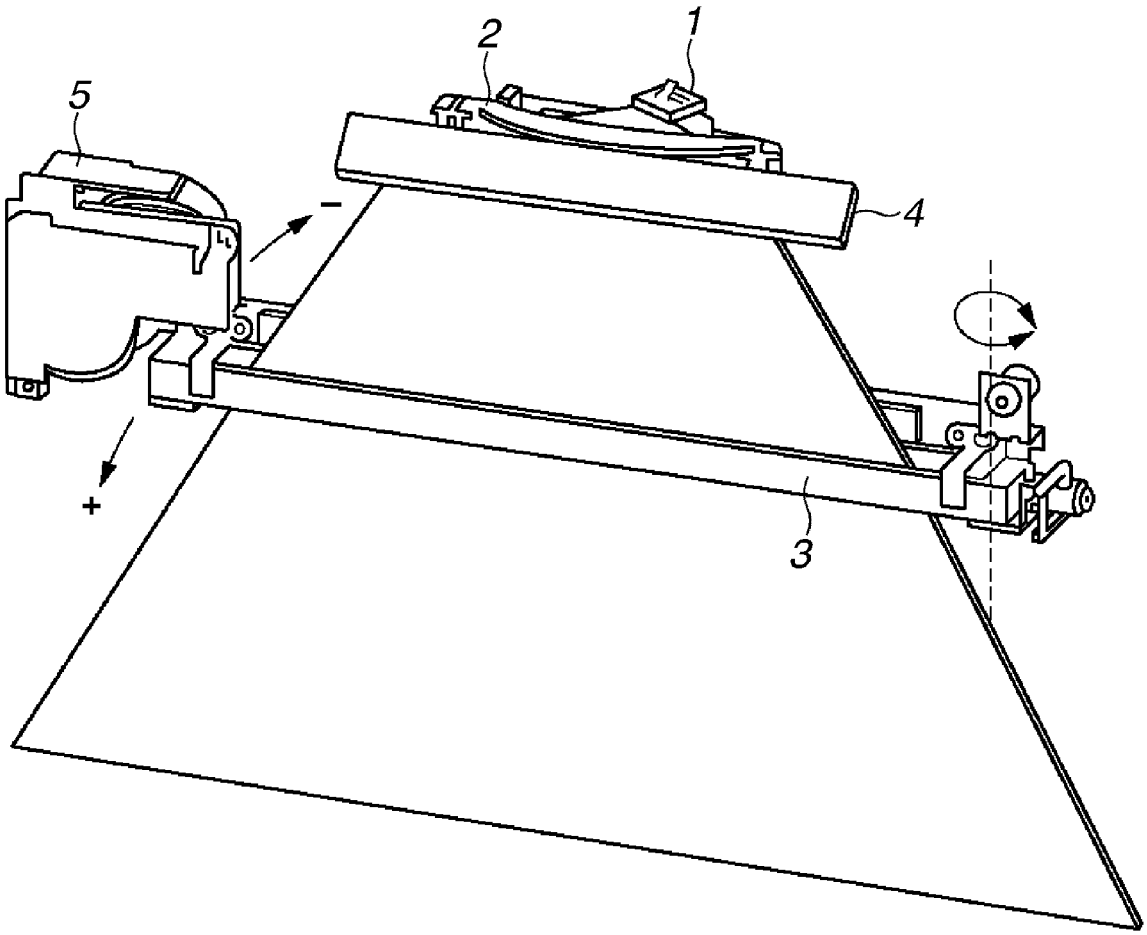
FIG. 1 is a diagram illustrating a scanning optical apparatus according to an exemplary embodiment of the present invention.

FIG. 1 is a diagram illustrating a scanning optical apparatus according to an exemplary embodiment of the present invention. The scanning optical apparatus is also referred to as an optical scanner apparatus, an optical scanning apparatus, or an exposure apparatus.

A polygonal mirror 1 is a rotating multi-faceted mirror that deflects and scans a flux of light (laser beam, light beam) output from a light source, such as a semiconductor laser, on the photosensitive drum. The polygonal mirror 1 and the semiconductor laser are an example of an exposure unit that draws scanning lines on the image bearing member by exposing the image bearing member with a beam according to image data. The photosensitive drum is an example of the image bearing member that bears an image. The polygonal mirror 1 can be a reflecting mirror that makes a reciprocating motion.

A first imaging lens 2 and a second imaging lens 3 are optical parts that cause the deflected and scanned light flux to form an image on the surface of the image bearing member and convert the light flux into constant-speed scanning light. A first folding mirror 4 reflects the light flux. The first imaging lens 2, the second imaging lens 3, and the first folding lens 4 are examples of the optical parts located on the optical path extending from the exposure unit to the image bearing member.

A drive unit 5 is a mechanism that includes a motor to drive the second imaging lens 3 included in a plurality of optical parts, and a measurement unit to measure an amount of driving of the motor, to correct the inclinations of the scanning lines. That is, the drive unit 5 is an example of a drive unit that drives the optical parts provided along the optical path from the exposure unit to the image bearing member to reduce the amounts of deviation detected by a detection unit. Furthermore, the drive unit 5 is also an example of an inclination correction unit to correct inclinations of the scanning lines by driving the optical parts. The inclinations are one of a plurality of components that constitutes an amount of deviation.

As described above, in a multi-color image forming apparatus having a plurality of photosensitive drums, the optical parts may thermally expand by the heat generated when the apparatus is operating. Owing to this thermal expansion, the relative exposing positions of the respective colors deviate from each other, causing color misregistration. To correct the color misregistration, it is desirable to stop the job whenever the temperature of the apparatus rises to a predetermined level, and carry out correction of the color misregistration. As a means for correcting color misregistration, there is a method of changing the positions of the optical parts according to the amounts of deviations generated. In FIG. 1, when the drive unit 5 drives the second imaging lens 3, the second imaging lens 3 rotates in the arrow direction (+or −) around the right end portion as the rotating center. The rotating center is illustrated by a broken line at the right end of the second imaging lens 3 in FIG. 1.

Figure 2:
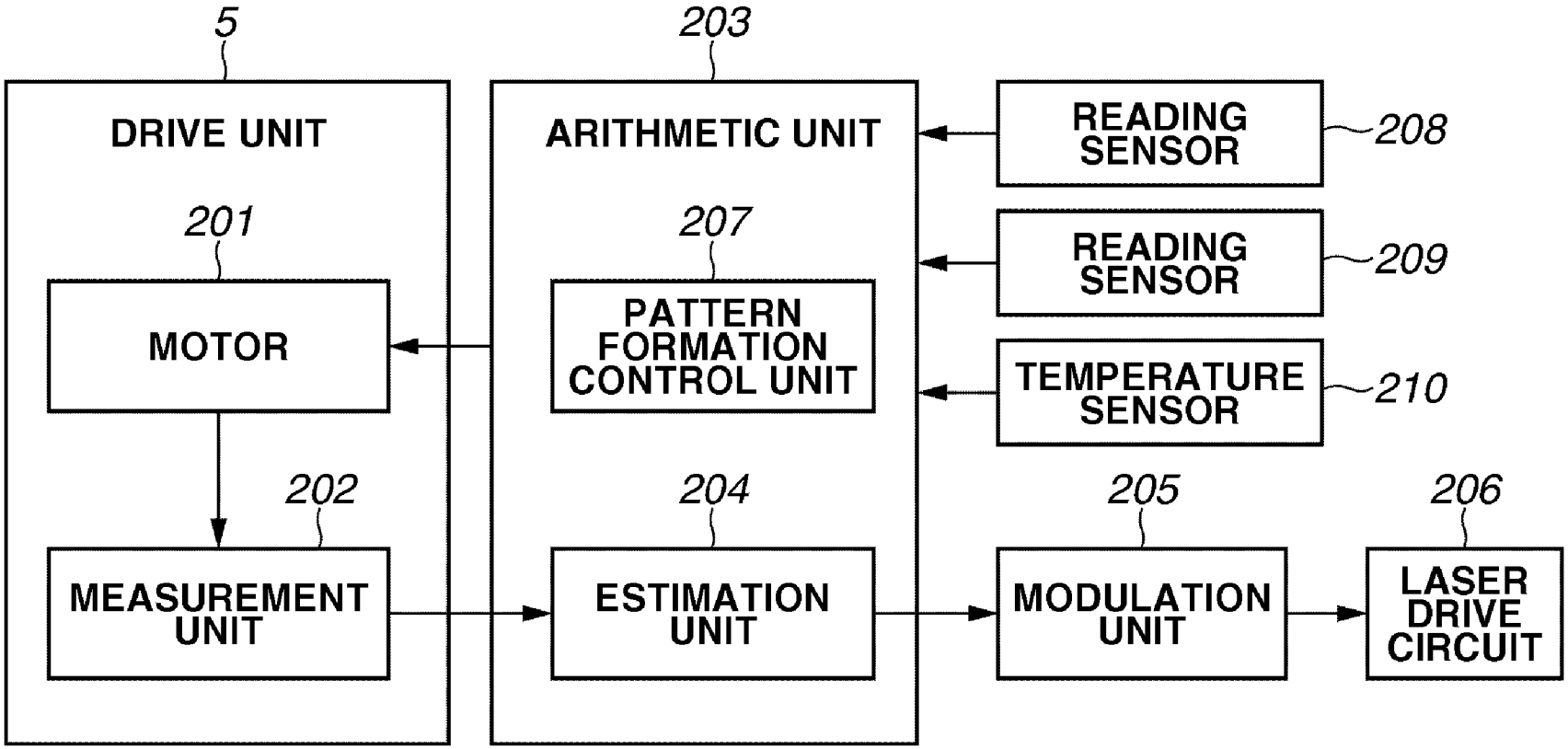
FIG. 2 is a diagram illustrating an example of a control unit according to an exemplary embodiment of the present invention.

FIG. 2 is a diagram illustrating an example of the control unit according to an exemplary embodiment of the present invention. A motor 201, which rotates in response to a command from an arithmetic unit 203, drives the second imaging lens 3 in one of a plurality of optical parts. A measurement unit 202 is a circuit to measure an amount of driving of the motor 201. This measurement operation includes calculation of numerical values and reading numerical data from a table and the storage unit. If the motor 201 is a stepping motor, the measurement unit 202 can be realized, for example, by a counter that counts the number of steps (pulses applied to the motor 201) of the motor 201. Note that the measurement unit 202 can be provided in the arithmetic unit 203. As described above, the measurement unit 202 is an example of a measurement unit that measures an amount of driving of the drive unit. Meanwhile, an amount of driving of the drive unit can be considered as an amount of movement (an amount of positional change) of an optical part driven by the drive unit.

The arithmetic unit 203 includes a central processing unit (CPU), a read only memory (ROM), and a random access memory (RAM). The arithmetic unit 203 includes, among others, an estimation unit 204 that estimates a residual amount of deviation (residual error) after correcting the deviation of the exposing position (e.g., inclinations of the scanning lines) by driving the second imaging lenses 3. The estimation unit 204 is an example of an estimation unit that estimates a residual amount of deviation based on the amount of driving. For example, the estimation unit 204 obtains residual error by multiplying an amount of driving by a predetermined coefficient. The predetermined coefficient is a degree of influence that an amount of movement of the second imaging lens 3 has on an amount of residual amount of deviation, namely, a degree of optical sensitivity. In an optical apparatus with high sensitivity, even when a residual amount of movement of the second imaging lens 3 (an amount of driving of the motor) is small, the residual error tends to be large. On the other hand, in an optical apparatus with low sensitivity, even when a residual amount of movement of the second imaging lens 3 (an amount of driving of the motor) is large, the residual error tends to be small. In addition, a degree of sensitivity can be expressed as a function of an image height. For example, by measuring amounts of change along the main scanning position and the sub scanning position at different image heights when the second imaging lens 3 is rotated for a predetermined angle (e.g., 1'), and by using these measured values, a function is obtained by approximating a degree of sensitivity with respect to image height. Also, a plurality of functions with respect to a plurality of rotation angles is made. Thereby, when correcting an inclination, by determining a rotation angle based on an amount of driving, a function corresponding to a determined rotation angle can be selected. Then, if a desired image height is substituted in the selected function, the estimation unit 204 can calculate sensitivity at that image height, so that by multiplying the amount of driving by the calculated sensitivity, an amount of deviation (residual error) after the inclination correction can be calculated.

A pattern formation control unit 207 controls a modulation unit 205 and a laser drive circuit 206 to form a pattern with toner to measure an amount of deviation of the exposing position. The pattern formation control unit 207 and the laser drive circuit 206 are a example of a pattern formation unit that forms a pattern used to detect an amount of deviation in the exposing position due to the exposure units. The pattern formation control unit 207 calculates an amount of deviation of the exposing position by reading a formed pattern with the reading sensors 208 and 209 and analyzing signals from the reading sensors 208 and 209. Then, the pattern formation control unit 207 rotates the motor 201 of the drive unit 5 to reduce the amount of deviation. Thus, the inclinations of the scanning lines as one of components causing an amount of deviation are corrected. The pattern formation control unit 207 and the reading sensors 208 and 209 are examples of at least two detection units that detect an amount of deviation of the exposing position due to the exposure unit. More specifically, the pattern formation control unit 207 and the reading sensors 208 and 209 can be formed with a charge-coupled device (CCD) or a complementary metal-oxide semiconductor (CMOS). The reading sensors 208 and 209 are an example of a reading unit used to read a pattern.

The amount of deviation after correcting the inclinations of the scanning lines is the residual amount of deviation described above (components corresponding to curvature and partial magnification). The estimation unit 204 causes the modulation unit 205 to modulate an image clock to reduce the estimated residual amount of deviation. The modulation unit 205 is an example of a modulation unit to modulate a frequency of an image clock in the exposure unit to reduce the estimated residual amounts of deviation. The modulation unit 205 is also an example of a curvature component correcting unit that corrects a curvature component in the residual amount of deviation left uncorrected by an inclination correcting unit. The curvature component is generated due to differences of partial magnifications of an image, along the main scanning direction, at each image height.

The laser drive circuit 206 drives a light source according to an image clock output from the modulation unit 205. A temperature sensor 210 is an example of a measuring unit that measures the temperature in the image forming apparatus. The temperature sensor 210 is used to determine a predetermined amount of change in temperature, which is a condition for executing a correction process. The temperature sensor 210 is an example of a measuring unit to measure temperature in the image forming apparatus.

Figure 3:
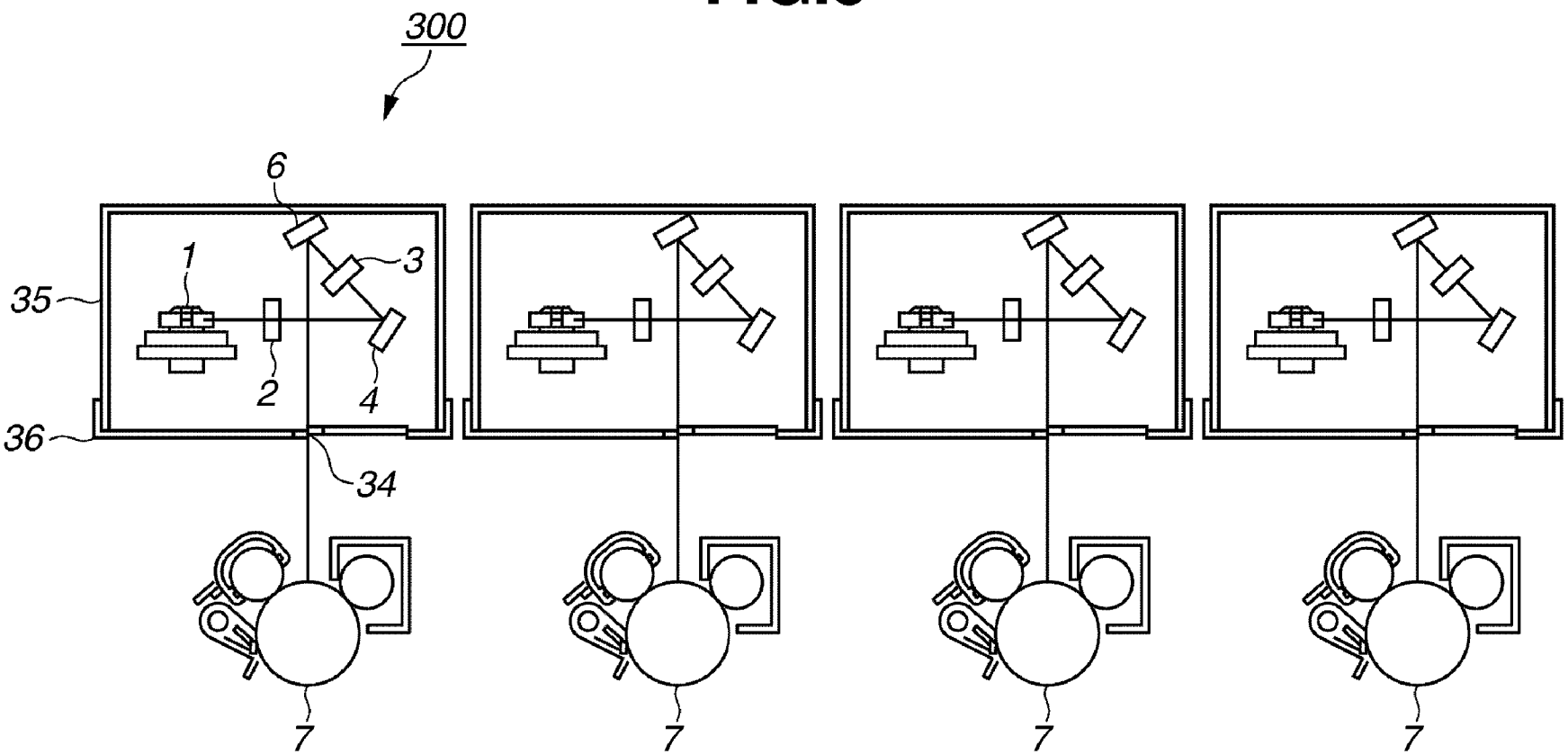
FIG. 3 is a cross-sectional diagram of a scanning optical apparatus mounted in an image forming apparatus that forms a multicolor image by using electrophotographic process.

FIG. 3 is a cross-sectional diagram of a scanning optical apparatus, which is mounted in an image forming apparatus, that forms a multi-color image using an electrophotographic process. The parts that have been described with reference to FIG. 1 are denoted using the same reference numerals. A scanning beam reflected by a second folding mirror 6 exposes, via a dust-proof glass 34, the surface of a photosensitive drum 7, and forms an electrostatic latent image. The scanning optical apparatus 300 includes an optical box 35 to accommodate various optical parts, and a lid 36 to fix the dust-proof glass 34 and to shield the scanning optical apparatus 300.

As described above, the scanning optical apparatus 300 and other parts may be thermally expanded or be deformed by the heat generated while the image forming apparatus is operating. As a result, the position exposed by a scanning beam changes (deviates). To be more specific, the causes for this phenomenon are as follows.

(1) Due to a thermal expansion of the optical box 35 and a change of the refraction index of the lenses in the scanning optical apparatus 300, the irradiation position and the angle of the beams of respective colors will change.

(2) Due to an expansion of parts supporting the photosensitive drum 7, the relative position of the photosensitive drum 7 and the beams will change.

(3) Due to a thermal expansion of gears used to drive the photosensitive drum 7, the feed speed of the photosensitive drum 7 or the transfer member will change, resulting in deviation of exposure timing for respective colors.

Figure 4:
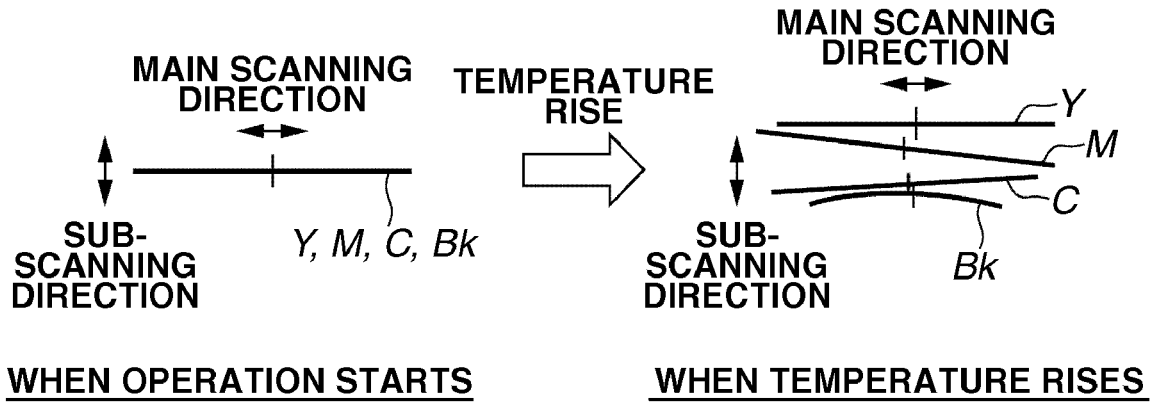
FIG. 4 is a schematic diagram illustrating a state where color misregistration occurs when the temperature rises.

FIG. 4 is a schematic diagram illustrating a state where color misregistration occurs when the temperature rises. In FIG. 4, to explain lucidly, the amount of change is shown in an exaggerated manner. In FIG. 4, the scanning lines Y, M, C, and Bk correspond to colors yellow, magenta, cyan, and black, respectively. As shown in the left diagram in FIG. 4, the positions of the scanning lines of respective colors coincide with each other when the operation of the image forming apparatus starts. However, as the temperature rises, changes of the scanning lines occur in the magnification and the writing position, along the main scanning direction, and also changes occur in the exposing position, in the inclination and in the curvature, along the sub scanning direction. Further along the main scanning direction, the optical center position also changes, with the result that the image may expand or contract at each different image height (in the main scanning position). This phenomenon is referred to as change in partial magnification. Generally, change in partial magnification can be approximated by a function of sixth order or some other order.

Figure 5:
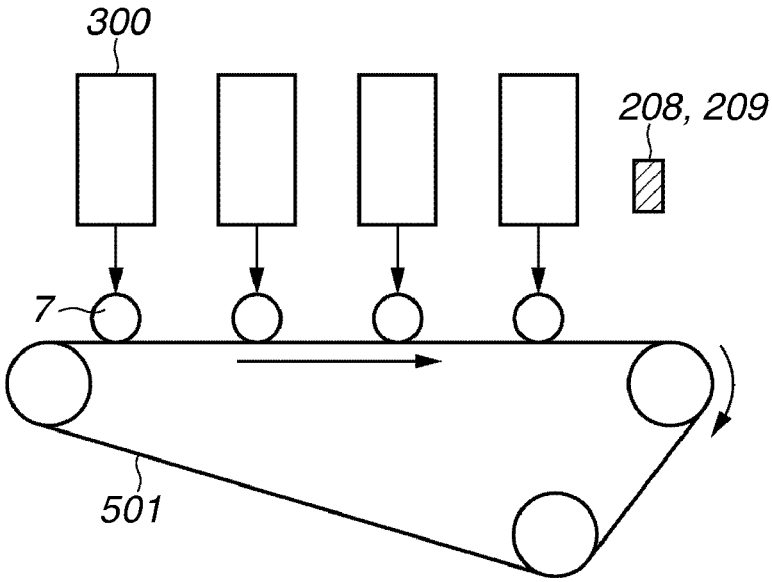
FIG. 5 is a cross-sectional diagram of the image forming apparatus.

FIG. 5 is a cross-sectional diagram of the image forming apparatus. An electrostatic latent image on each photosensitive drum 7 is developed and a toner image is transferred to a transfer member 501. A pattern used to detect an amount of deviation described above is formed as a toner image on the transfer member 501.

Figure 6:
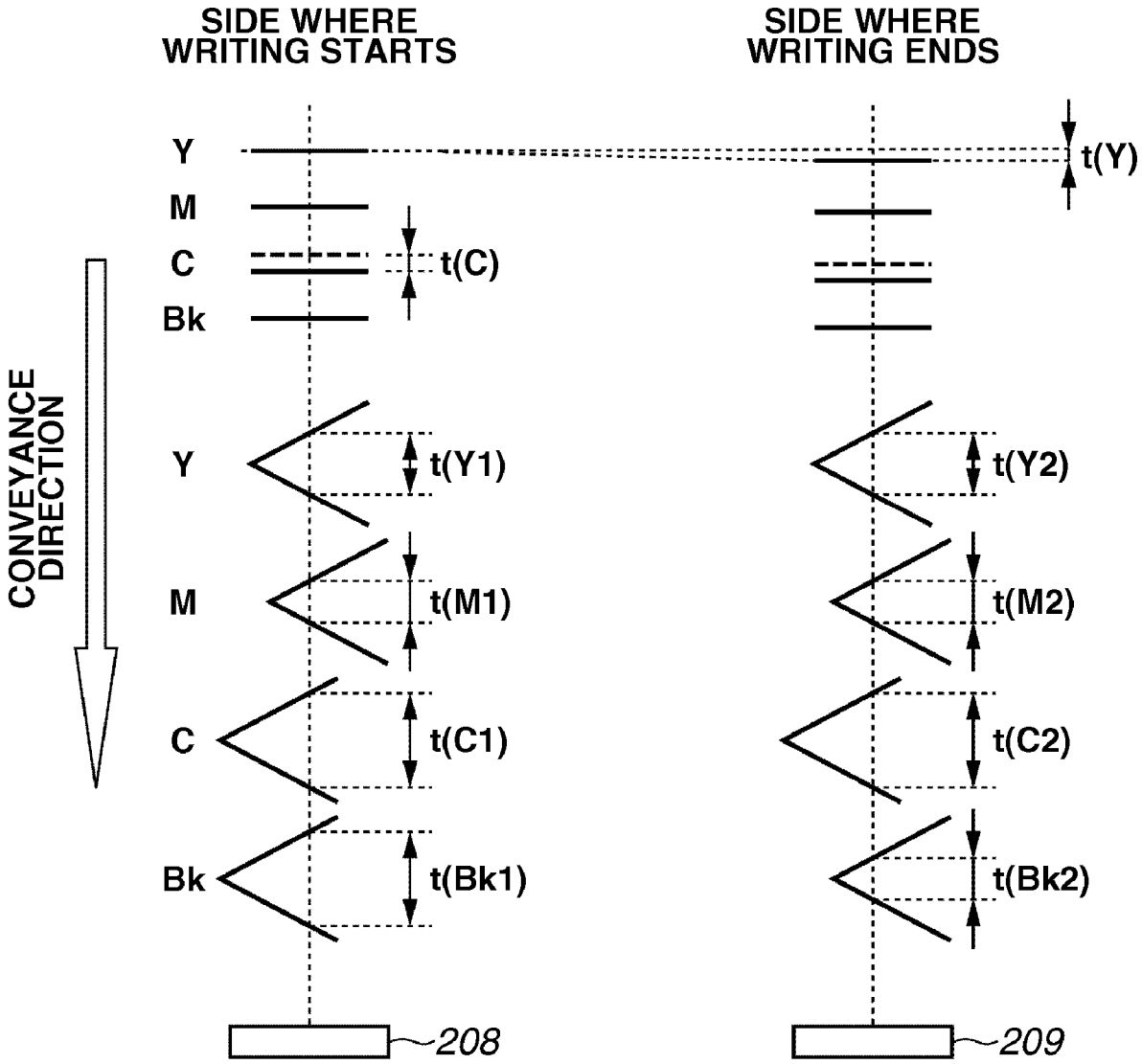
FIG. 6 is a diagram illustrating an example of a pattern formed on the transfer member and also illustrating deviation at each pattern forming position.

FIG. 6 is a diagram illustrating an example of a pattern formed on the transfer member 501 and also illustrating deviation in each pattern forming position. The reading sensors 208 and 209 are arranged downstream of the photosensitive drum 7 and in the vicinity of both sides apart at an image width to each other. The both sides correspond respectively to the start position and the end position of the image writing. The image width is the length (distance) from the start position to the end position of the image writing.

In FIG. 6, two kinds of patterns are illustrated. Each of the straight horizontal lines is used to detect an inclination of a scanning line. Base on a time difference between the times at which a horizontal line is detected respectively by the reading sensors 208 and 209, the arithmetic unit 203 calculates an amount of inclination of the scanning line. By detecting a time difference between the times when a horizontal line of a specific color is detected and when a horizontal line of another color is detected, the arithmetic unit 203 can detect an amount of deviation t(C) in writing timing of the scanning line. t(C) denotes an amount of deviation for cyan.

The amount of deviation along the main scanning direction can be detected by drawing dogleg patterns as shown in FIG. 6, and by measuring a transit time thereof and a time difference thereof positioned on both sides. For example, if an angle formed by the upper side of the dogleg pattern and the conveyance direction is designated as θ, by multiplying the transit time by tan θ, an amount of deviation along the main scanning direction can be obtained. For example, if the transit time of yellow at the left and right sides is expressed as t(Y1) and t(Y2), time differences at the left and right sides along the main scanning direction are obtained as t(Y1) tan θ and t(Y2) tan θ, respectively.

Compared with the transit time of yellow, a transit time t(M1) of magenta on the writing start side is shorter and a transit time t(M2) of magenta on the writing end side is shorter, too. This means that the "dogleg" pattern of magenta is shifted to the right. With regard to cyan, since t(C1)>t(Y1) and t(C2)>t(Y2), it is known that the pattern of cyan is shifted to the left. With regard to black, since t(Bk1)>t(Y1) and t(Bk2)<t(Y2), it is obvious that the magnification of black is larger than the magnification of yellow.

Figure 7:
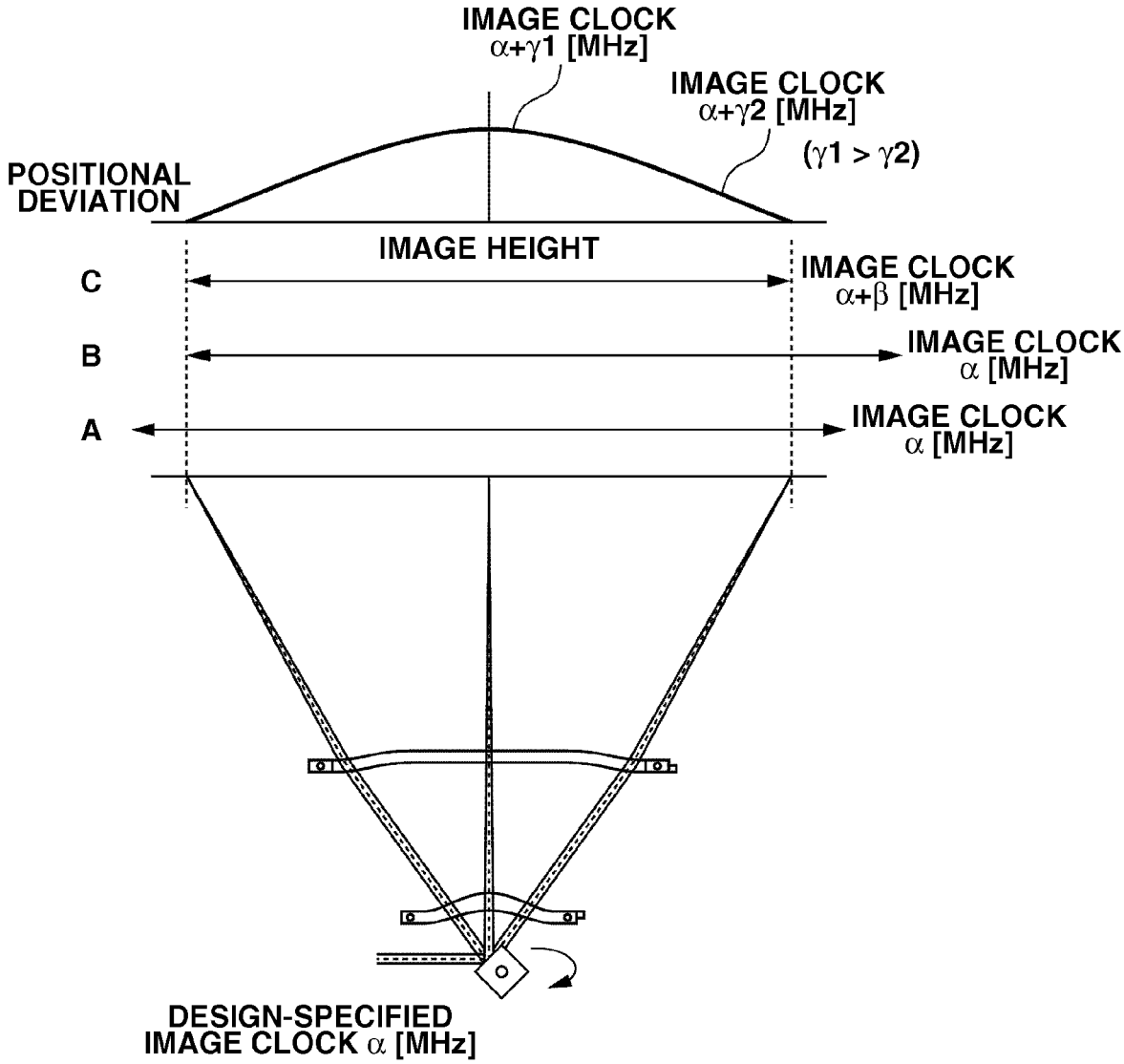
FIG. 7 is a diagram illustrating an example of a color misregistration correction process.

FIG. 7 is a diagram illustrating an example of a color misregistration correction process. The arrows A, B, and C in FIG. 7 indicate a correction process of an image width (magnification). The data (graph) in the upper area of FIG. 7 concerns partial magnification. The scanning line and the positional deviation in FIG. 7 are illustrated on an exaggerated scale for ease of explanation.

The magnification of an image formed on the photosensitive drum becomes greater than a standard magnification as the apparatus enter into regular operation. As illustrated by A, the image tends to be wider along the main scanning direction. As a color misregistration correction process is started, the writing start position is corrected as indicated by B. The scanning optical apparatus includes a writing start position synchronization sensor (beam detection sensor). By changing a set value of delay time, which is from a timing when a signal is output from the beam detection sensor to a timing when actual writing of an image is started, according to an amount of deviation, the start position of writing a scanning line is corrected to the position indicated by B. By this stage, the image clock has not been corrected.

Then, the magnification of the image is corrected by changing the image clock. A scanner motor, which rotates the polygonal mirror 1, rotates at a specified rotating speed. Therefore, if an image signal to be written has a higher frequency than a predetermined frequency, transmission of an image signal is completed earlier than a predetermined time, resulting in a contracted image. On the other hand, if a write image signal has a lower frequency, an image will be enlarged.

By using the above principle, to correct the enlarged image width as shown by B to a predetermined image width, the modulation unit 205 increases the image clock frequency by a correction amount β. Thereby, the magnification is corrected. This method, when applied to smaller areas along the main scanning direction, is referred to as frequency modulation. For example, when an image with the partial magnification shown in the upper area of FIG. 7 is to be corrected, if the scanning direction is in the + direction, it is only necessary to write the image with a higher clock as the amount of deviation at an image height in the + direction increases. On the other hand, if the amounts of deviation increase in the − direction, it is necessary to write the image with a slower clock. Note that the image clock need not be increased or decreased continuously. For example, by dividing the main scanning region along the main scanning direction into a plurality of areas and applying a differently modulated image clock according to an amount of deviation to each divided area, sufficient correction effects can be obtained.

As illustrated in FIG. 7, when a partial magnification varies, the scanning line is curved. Therefore, to even out the partial magnification at each area along the main scanning direction (in other words, to correct a scanning line to be straight), it is necessary to measure a degree of curvature thereof. However, to measure the degree of curvature with high accuracy, many reading sensors need to be arranged as shown in Japanese Patent Application Laid-Open No. 2004-170755. More specifically, with two reading sensors, which are provided as shown in FIG. 2, it is possible to obtain only information about inclinations of the scanning lines and an overall magnification (the width of the scanning line). On the other hand, it is known from experience that there is a certain relationship between an amount of correction for an inclination (an amount of driving of the motor 201) and a degree of curvature. Therefore, if an amount of driving of the motor 201 can be measured, an amount of deviation or an amount of correction about partial magnification can be estimated.

Figure 8:
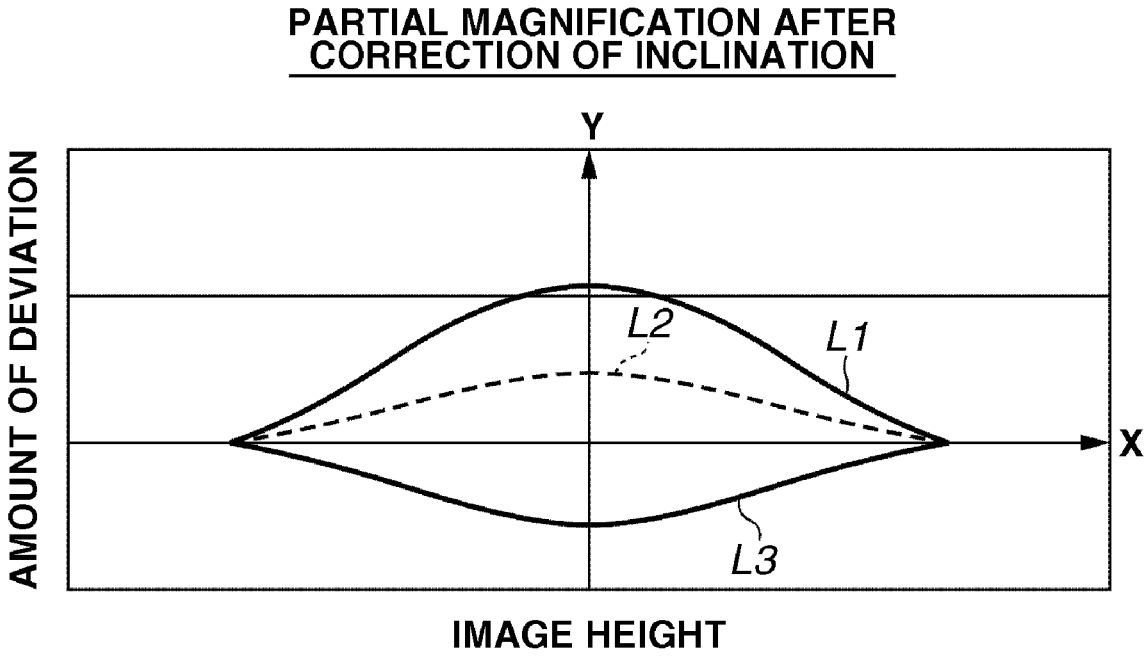
FIG. 8 is a diagram illustrating an amount of deviation at each image height after inclinations of the scanning lines are corrected.

FIG. 8 is a diagram illustrating an amount of deviation at each image height after inclinations of the scanning lines are corrected. L1, L2 and L3 are examples of the partial magnifications according to differences in amounts of driving of the motor 201. L1 and L2 denote the partial magnifications when the motor 201 is driven to turn the second imaging lens 3 in the + direction. The amount of driving for L1 is larger than the amount of driving for L2. This is because a changing amount of a partial magnification is proportional to an amount of driving of a motor. L3 denotes an example of a partial magnification that occurs when the second imaging lens is turned in the − direction.

The profile of such a partial magnification is defined by a sixth order function:

$$Y=a\cdot x^6+b\cdot x^5+c\cdot x^4+d\cdot x^3+e\cdot x^2+f\cdot x+g$$

where "a" to "g" in this equation are coefficients, which are determined by an amount of driving of the motor 201 as well as by the structure of the image forming apparatus and characteristics of the optical parts. In other words, the estimation unit 204 estimates profiles of partial magnification as a residual amount of deviation after inclination correction based on an amount of driving of the motor 201. Above all, by estimating profiles of partial magnifications, the number of times of forming patterns can be reduced. The arithmetic unit 203 generates a profile of correction from a profile of calculated amount of deviation.

Figure 9:
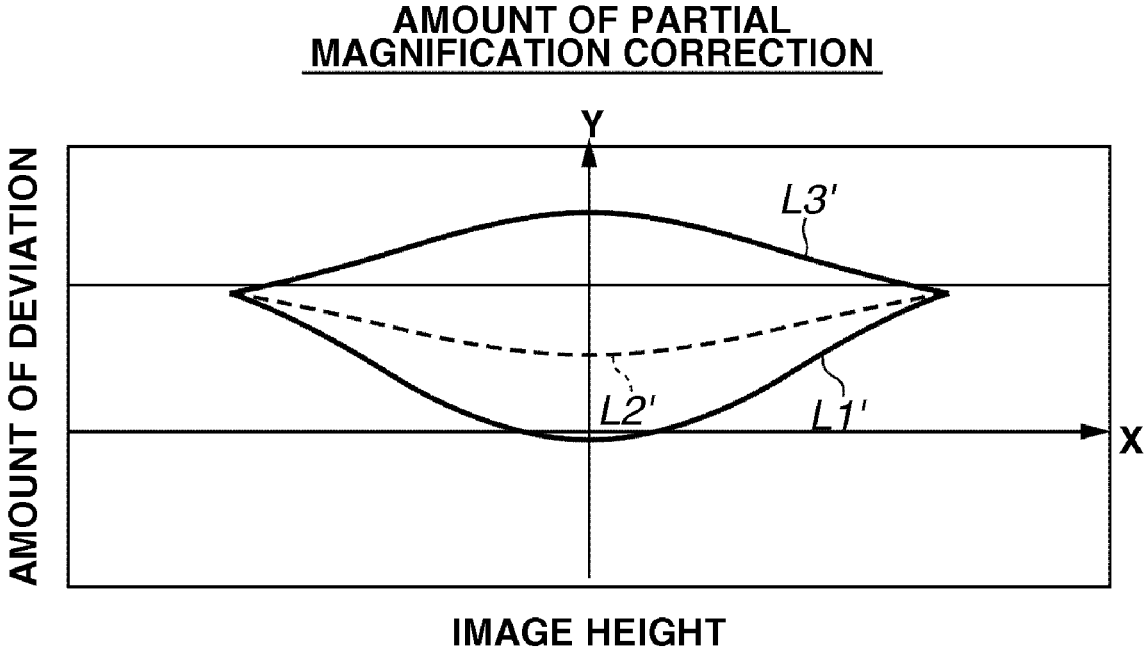
FIG. 9 is a diagram illustrating an example of a correction profile to cancel an amount of correction for partial magnification.

FIG. 9 is a diagram showing an example of a correction profile as an amount of correction for partial magnification. L1', L2', and L3' correspond respectively to L1, L2, and L3 as the profiles of the amounts of deviation shown in FIG. 8. As a comparison between FIG. 8 and FIG. 9 suggests, the corrected profile is formed by inverting the signs (+ and −) of the profile of the amount of deviation. The modulation unit 205 generates modulation data to modulate the image clock by using a correction profile generated, and transmits a modulated image data signal to the laser drive circuit 206.

Figure 10:
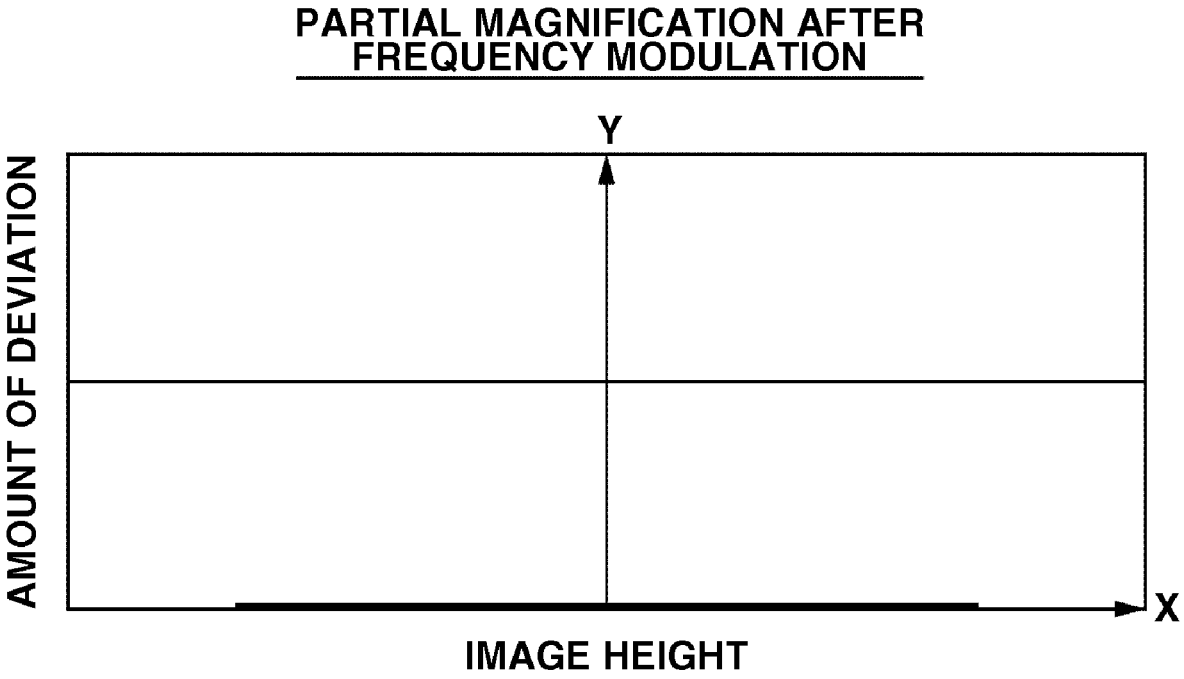
FIG. 10 is a diagram illustrating an example of partial magnifications corrected by using frequency modulation according to an exemplary embodiment of the present invention.

FIG. 10 is a diagram illustrating an example of partial magnification corrected by frequency modulation according to an exemplary embodiment of the present invention. In this exemplary embodiment, the partial modification on an image is made uniform by estimating a residual amount of deviation from an amount of driving during inclination correction, determining an amount of modulation of an image clock required for correcting the residual amount of deviation, and modulating the image clock according to a determined amount of modulation.

Figure 11:
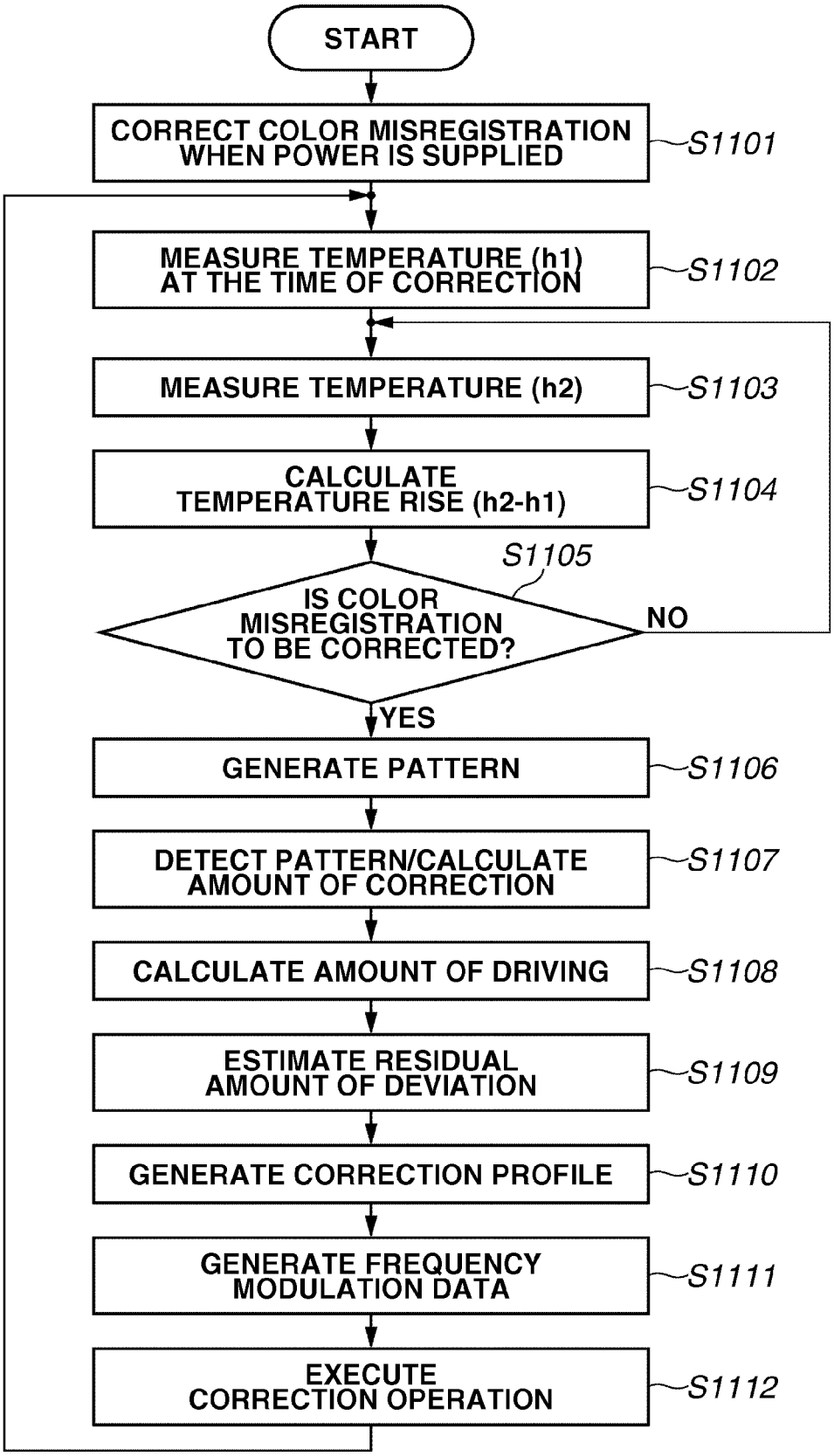
FIG. 11 is a flowchart illustrating an example of a correction process according to an exemplary embodiment of the present invention.

FIG. 11 is a flowchart illustrating an example of a correction process according to an exemplary embodiment of the present invention. When electric power is supplied to the image forming apparatus, in step S1101, the arithmetic unit 203 executes a first color misregistration correction operation to correct color misregistration in the initial state. This correction operation corresponds to an operation in steps S1106 to S1112, which will be described later. In step S1102, the arithmetic unit 203 measures a temperature h1 at the end of a correction process with the temperature sensor 210, and stores the temperature h1 in an internal memory thereof.

In step S1103, the arithmetic unit 203 measures a temperature h2 with the temperature sensor 210. Timing for measuring the temperature h2 can be at regular intervals or when some other condition is satisfied. In step S1104, the arithmetic unit 203 obtains an amount of change in temperature (amount of temperature rise) by calculating a difference between the temperature h1 and the temperature h2. The arithmetic unit 203 is an example of a calculating unit to calculate an amount of change in temperature.

In step S1105, the arithmetic unit 203 determines whether the calculated amount of temperature change meets a condition for correcting color misregistration. For example, the arithmetic unit 203 determines whether an amount of change has exceeded a predetermined threshold value. The arithmetic unit 203 is an example of a determination unit to determine whether an amount of temperature change is larger than a predetermined threshold value. When the amount of temperature change has exceeded the predetermined value (YES in step S1105), the process proceeds to step S1106 to correct color misregistration. If the amount of temperature change has not exceeded a predetermined threshold value (NO in step S1105), the process returns to S1103.

In step S1106, the pattern formation control unit 207 outputs image data for a pattern to the laser drive circuit 206. Then, an electrostatic latent image of the pattern is formed on the photosensitive drum 7, a toner image is formed thereon, and finally the toner image of the pattern is transferred to the transfer member 501. In this manner, when an amount of temperature change exceeds a predetermined level, the pattern formation control unit 207 forms a pattern to correct the amount of deviation.

In step S1107, the arithmetic unit 203 detects a pattern with the reading sensors 208 and 209 and then calculates an amount of inclination correction obtained by the result of the pattern detection. For example, the arithmetic unit 203 calculates an inclination from a time difference between a time when the pattern is detected with the reading sensor 208 and a time when the pattern is detected with the reading sensor 209. The arithmetic unit 203 includes a timer or a counter to measure a time difference described above. The arithmetic unit 203 obtains an overall magnification along the main scanning direction and the amount of deviation of the writing start position by detecting the dogleg patterns and then calculates an image clock frequency and a delay time to start writing.

In step S1108, the measurement unit 202 measures an amount of driving (a number of drive pulses) of the motor 201 to correct an inclination. The arithmetic unit 203 can calculate the number of drive pulses from an amount of inclination correction. In step S1109, the estimation unit 204 estimates a residual amount of deviation based on a measured or calculated amount of driving. For example, the estimation unit 204 generates a partial magnification profile after correcting the inclination by multiplying a partial magnification profile stored in a memory in advance by a number of drive pulses. The number of drive pulses is represented by a positive or negative value because it is necessary to take its direction into consideration.

In step S1110, the arithmetic unit 203 generates a correction profile from a partial magnification profile. For example, the arithmetic unit 203 generates a correction profile by inverting the signs of the partial magnification profile. In step S1111, the modulation unit 205 generates frequency modulation data from a correction profile. As described above, frequency modulation data is generated in such a way that when an amount of correction (partial magnification) is larger, the frequency is set to be higher, and when an amount of correction is smaller, the frequency is set to be lower. In step S1112, the modulation unit 205 outputs an image clock modulated with the frequency modulation data to the laser drive circuit 206.

Figure 12:
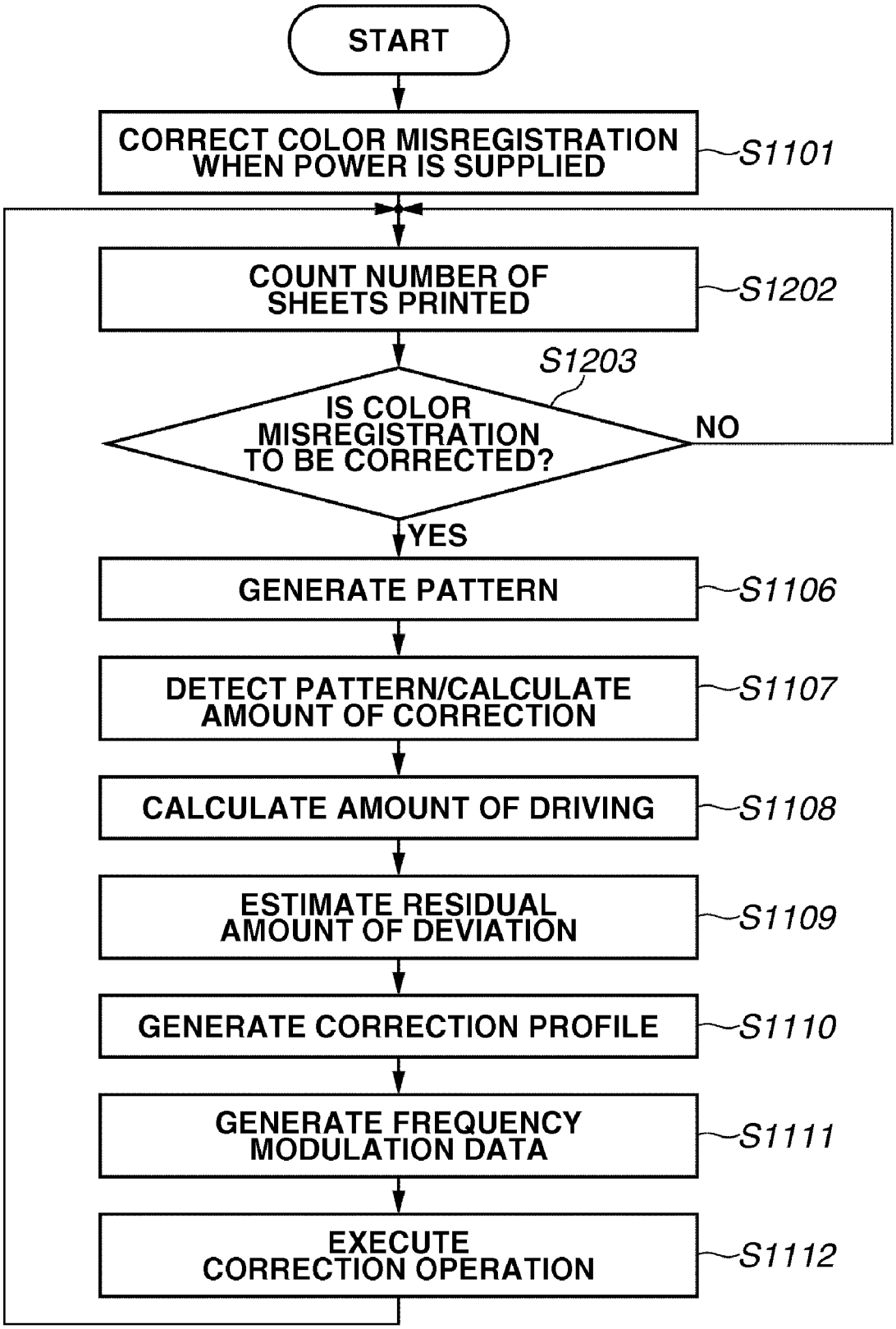
FIG. 12 is a flowchart illustrating another example of the correction process according to an exemplary embodiment of the present invention.

FIG. 12 is a flowchart illustrating another example of the correction process according to an exemplary embodiment of the present invention. As is understood by a comparison with FIG. 11, steps S1102 to S1105 concerning the condition for executing color misregistration correction is replaced by steps S1202 and S1203.

In step S1202, the arithmetic unit 203 counts the number of sheets printed whenever printing is performed. The arithmetic unit 203 is an example of a counting unit to count the number of sheets printed in the image forming apparatus.

In step S1203, the arithmetic unit 203 determines whether to correct color misregistration based on whether the counted number of sheets printed has exceeded a predetermined number. The arithmetic unit 203 is an example of a determination unit to determine whether the number of sheets printed has exceeded a predetermined number. In addition, each time the number of sheets printed has exceeded the predetermined number of sheets (YES in step S1203), the process proceeds to step S1106. In step S1106, the arithmetic unit 203 generates a pattern used to correct an amount of deviation, and carries out a correction operation. In this operation, the counter to count the number of sheets printed can be reset to zero or the predetermined number of sheets can be incremented by a certain number. On the other hand, if the number of sheets printed has not exceeded the predetermined number of sheets (NO in step S1203), the process returns to step S1202.

Generally, the arithmetic unit 203 can change the predetermined number of sheets in such a way that an interval for executing color misregistration is extended as the number of sheets printed on the image forming apparatus increases. Needless to say, the predetermined number of sheets can be fixed or can be varied dynamically. That is because the temperature rise characteristic is expressed as a first-order lag system, and the amount of temperature rise per sheet decreases according to elapse of time.

Figure 13:
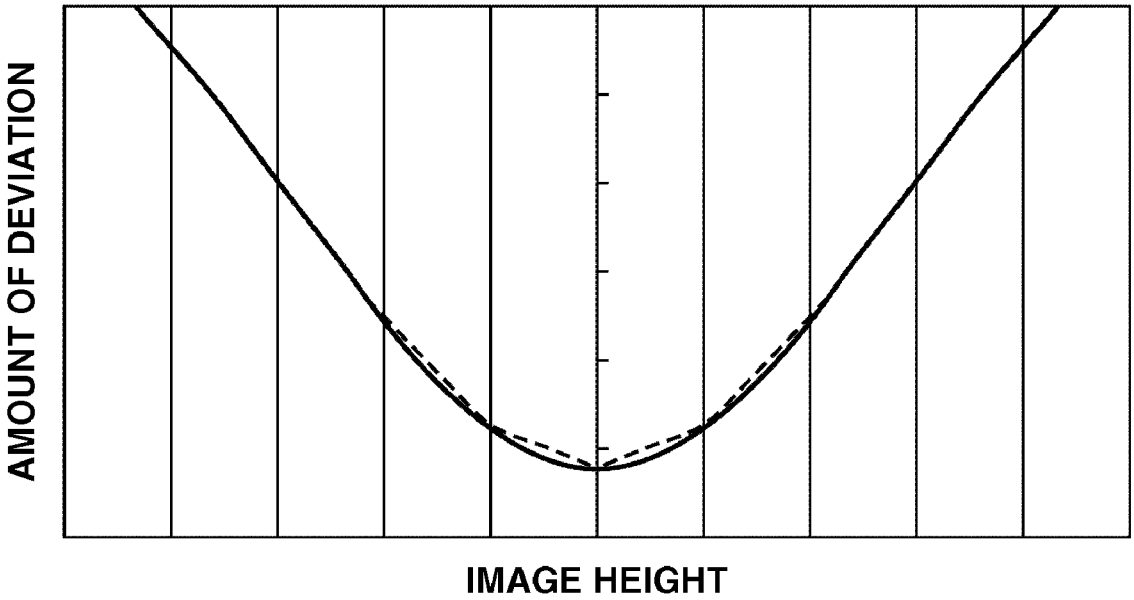
FIG. 13 is a diagram illustrating an example of a correction profile used to correct only a change in partial magnification caused by the correction of inclination.

FIG. 13 is a diagram illustrating an example of a correction profile used to correct only a change in partial magnification caused by correction of the inclination. As illustrated in FIG. 13, the main scanning area is divided into a plurality of areas along the main scanning direction by the vertical lines in FIG. 13. The amount of deviation at each image height corresponding to each vertical line is stored in a memory. An amount of deviation between adjacent vertical lines can be calculated by straight-line approximation, for example. In addition, the partial magnification profile approximated by using straight-line approximation indicates that the scanning speed in that area (section) is assumed to be constant. Therefore, if an image clock of a frequency corresponding to a certain inclination is set, the profile in the related area is corrected as indicated by the broken line. The difference between the broken line and the solid line denotes the residual amounts of deviation. As is understood from FIG. 13, where the profile gradually changes, effects of correction will not decrease so much even if the scanning area is divided into wider areas.

Figure 14:
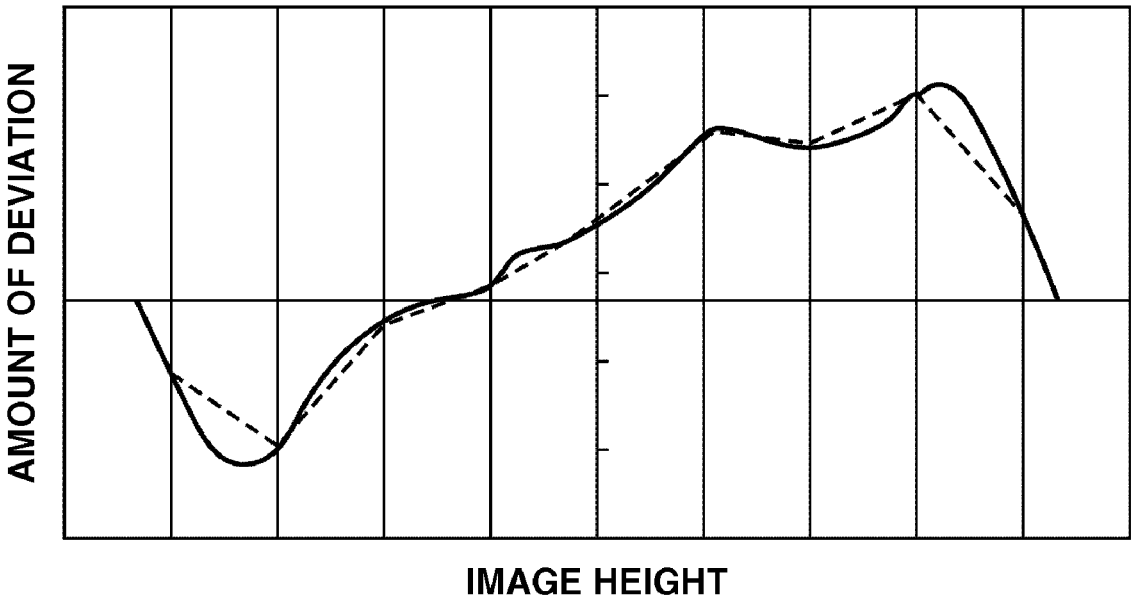
FIG. 14 is a diagram illustrating an example of a correction profile used to correct, considering an f-θ characteristic of the scanning optical apparatus, the change in partial magnification caused by the inclination correction.

FIG. 14 is a diagram illustrating an example of a correction profile used to correct, considering an f-θ characteristic of the scanning optical apparatus, the change in partial magnification caused by the inclination correction. Similar to FIG. 13, the frequency of modulation in each area is approximated by a straight line. Changes in the correction profile become sharp if the f-θ characteristic of the scanning optical apparatus is applied to the correction process. In this case, if straight-line approximation is used, an area may occur where there is a large difference between the ideal correction profile (solid line) and the actual correction profile (broken line). This is not desirable because residual amounts of deviation after correction will become large in that area. Therefore, in such a case, it is necessary to set small size areas or to modulate the frequency of the image clock by one dot unit.

As described above, a residual amount of deviation (an amount of change in partial modification) is estimated based on an amount of driving that is used for correcting an inclination of a scanning line, and the image clock is modulated to reduce the residual amount of deviation. Therefore, the image forming apparatus can maintain high image quality while reducing the number of reading sensors, the number of times of pattern formation, the amount of signal processing, and downtime.

More specifically, though it is necessary to form a pattern when correcting inclination of the scanning line, which is one of components constituting an amount of deviation, the image forming apparatus can omit forming a pattern when correcting partial magnification. To correct an inclination, only two reading sensors are necessary. Accordingly, the number of reading sensors and the number of times of pattern formation can be decreased. Accordingly, as the number of reading sensors and the number of times of pattern formation are reduced, the amount of signal processing and downtime are decreased.

In addition, it is desirable that the correction process according to an exemplary embodiment is executed when an amount of change in temperature exceeds a threshold value or the number of sheets printed exceeds a predetermined number of sheets. This is because those parameters are closely related to a magnitude of the amount of deviation.

Figure 15:
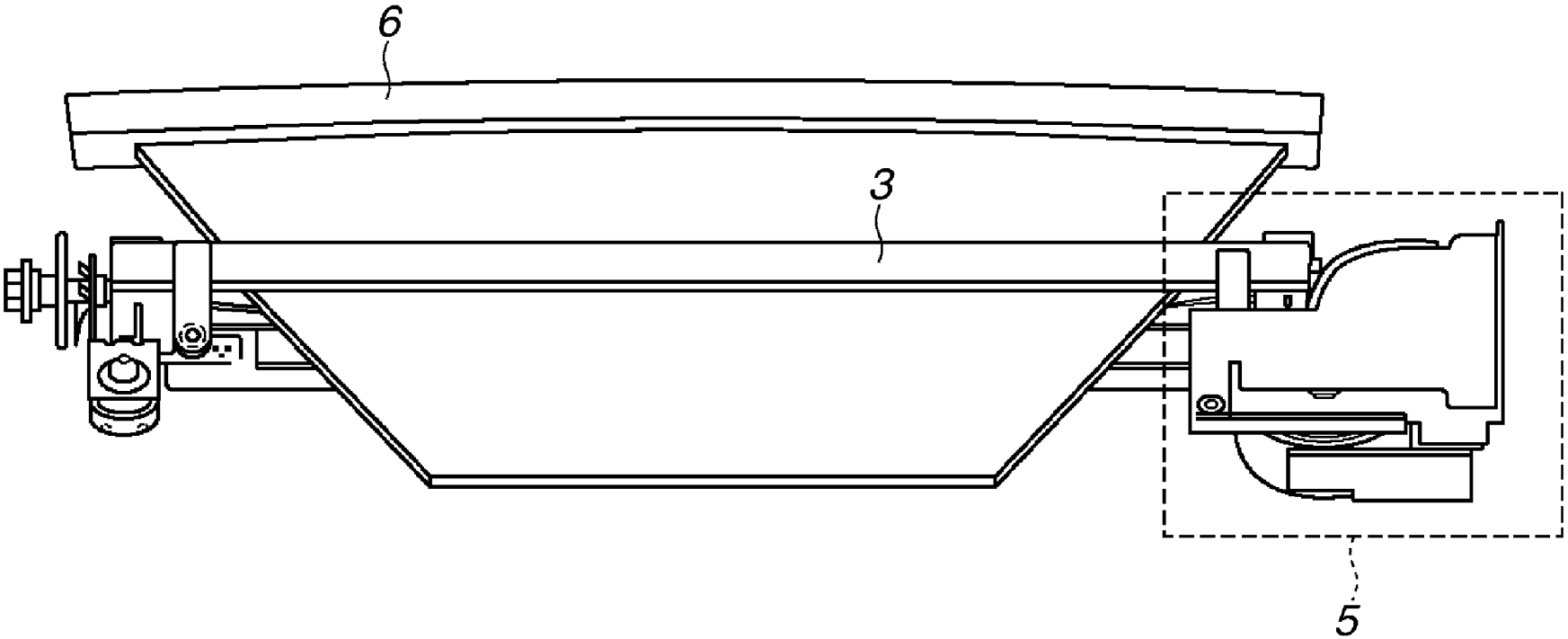
FIG. 15 is a diagram illustrating an example of a scanning optical apparatus including a curved folding mirror to correct curvature of a scanning line.

FIG. 15 is a diagram illustrating an example of a scanning optical apparatus including a curved folding mirror to correct curvature of a scanning line. FIG. 15 mainly illustrates a configuration of components around the second imaging lens 3 and the second folding mirror 6.

As illustrated in FIG. 15, the second folding mirror 6 has a shape curvature along the main scanning line. The second folding mirror 6 is an example of a folding mirror, in a plurality of optical parts, which is curved as a force is applied thereto in the longitudinal direction. The second folding mirror 6 has a stress applied thereto by a curvature-adjusting mechanical part which is provided at one or two positions along the longitudinal direction of the mirror and has an amount of curvature corresponding to the magnitude of the stress. The amount of curvature of the second folding mirror 6 is formed when a scanning optical apparatus is optically adjusted in a factory, for example. The amount of curvature is not constant, but is varied in a distribution. According to FIG. 15, a laser beam, after passing through the second imaging lens 3, is incident on the second folding mirror 6, and reflected toward the photosensitive drum 7.

Figure 16:
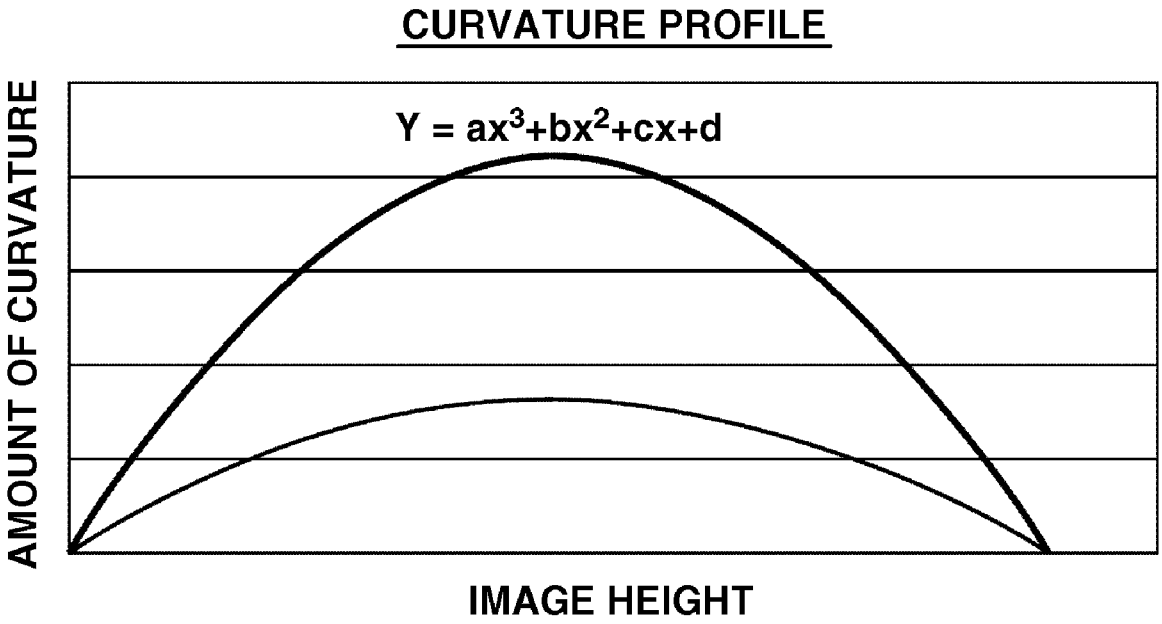
FIG. 16 is a diagram illustrating an example of a curvature profile of the reflecting surface of the folding mirror.
Figure 17:
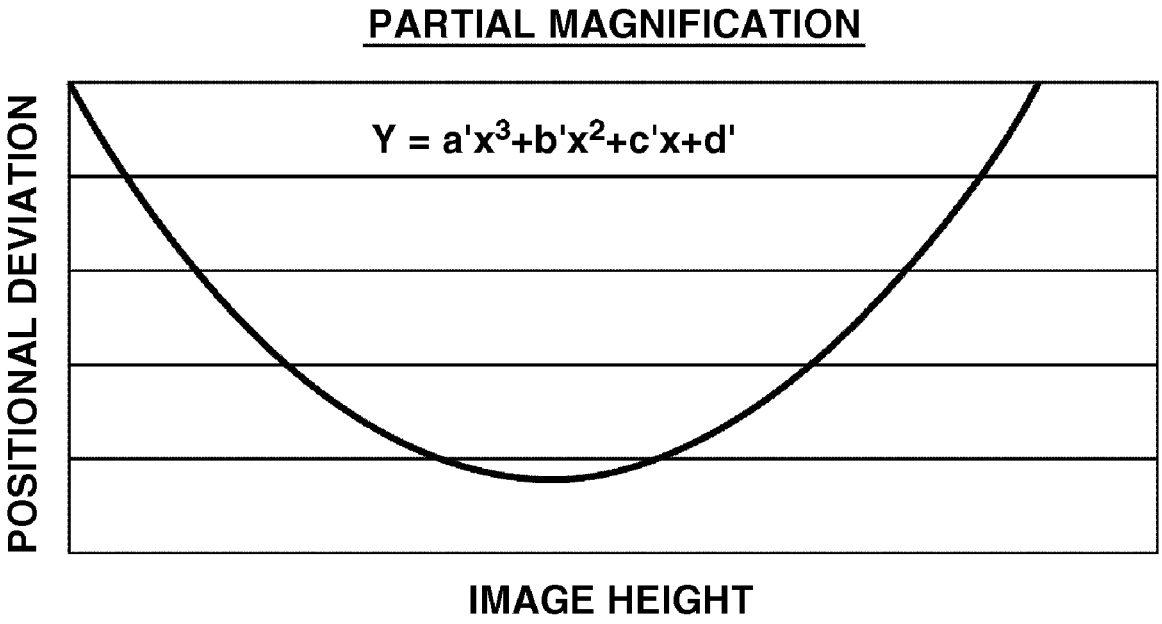
FIG. 17 is a diagram illustrating an example of partial magnification (positional deviation) due to the curvature of the folding mirror.

FIG. 16 is a diagram illustrating an example of a curvature profile of the reflecting surface of the folding mirror. FIG. 17 is a diagram illustrating an example of partial magnification (positional deviation) due to the curvature of the folding mirror.

The curvature profile can be expressed by a cubic function ($Y=a\cdot x^3+b\cdot x^2+c\cdot x+d$) in material mechanics. The curvature profile along the widthwise direction of the folding mirror can be expressed by a straight line. Incidentally, if symmetric stresses are applied at the middle point of or at both ends of the longitudinal direction of the folding mirror, the cubic term is eliminated, and as a result, the curvature profile is expressed by a quadratic function.

FIG. 16 illustrates two curvature profiles with mutually different amounts of curvature. Those profiles are formed when stresses symmetric but different in magnitude are applied near the left edge and the right edge of the folding mirror, and both profiles are represented by a cubic function.

If inclination correction described above is performed on a scanning optical apparatus including a curved folding mirror like this, the reflecting position of a light beam on the reflecting surface of the folding mirror changes after the above-described inclination correction compared with that before the inclination correction. Therefore, the partial magnification changes depending on an amount of inclination correction and an amount of curvature of the folding mirror.

FIG. 17 illustrates a change in partial magnification when inclination correction is carried out on a scanning optical apparatus using a curved folding mirror. The partial magnification profile representing the positional deviation is represented by a function different therefrom for the change in the partial magnification caused by the inclination correction. Therefore, in a scanning optical apparatus using a curved second folding mirror 6, it is necessary to estimate an amount of change (residual error) in the partial magnification by considering not only the variation in the partial magnification that occurs when the scanning line inclination is corrected by using the drive unit 5 but also the amount of curvature of the folding mirror and the amount of inclination correction.

For example, a cubic function representing a curvature profile (amount of curvature) is stored in the non-volatile memory of the arithmetic unit 203. The non-volatile memory of the arithmetic unit 203 is an example of a storage unit that stores the amount of curvature of the folding mirror. An amount of adjustment when the curvature is adjusted in the factory is also stored in the storage unit. The amount of adjustment is used by the arithmetic unit 203 when determining coefficients in the cubic function. The arithmetic unit 203 generates a cubic function representing a curvature profile by reading the amount of adjustment from the storage unit, and calculating the coefficients. The coefficients for the amount of inclination correction (an amount of driving) can be stored in the arithmetic unit 203 as a determined value when designed. Thus, the estimation unit 204 in the arithmetic unit 203 can calculate an amount of change in partial magnification caused by the curved second folding mirror 6. A final partial magnification profile is obtained by adding the curvature profile and the partial magnification profile, which represents an amount of change in partial magnification caused by inclination correction. The correction profile can be obtained by inverting the signs of the values in the final partial magnification profile. The arithmetic unit 203 or the estimation unit 204 is an example of a unit that estimates a residual amount of deviation based on the amount of curvature stored in the storage unit and also base on the amount of driving.

Figure 18:
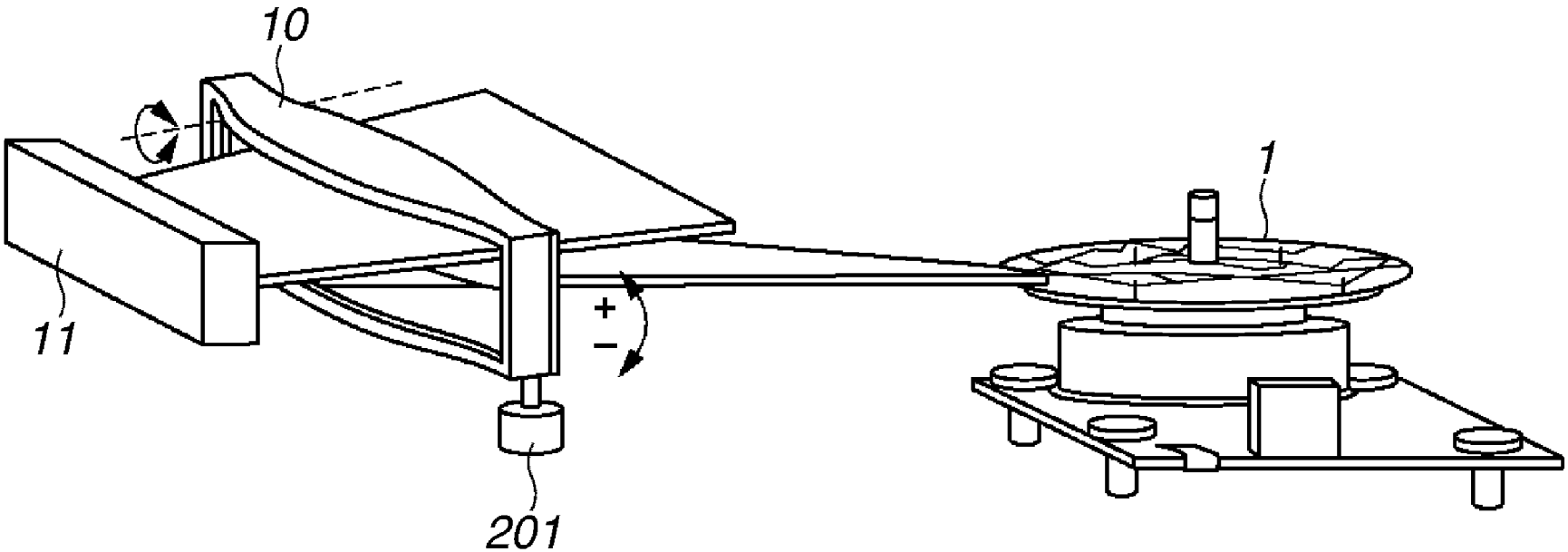
FIG. 18 is a diagram illustrating an example of an optical system having large change in partial magnification caused by inclination correction.
Figure 19:
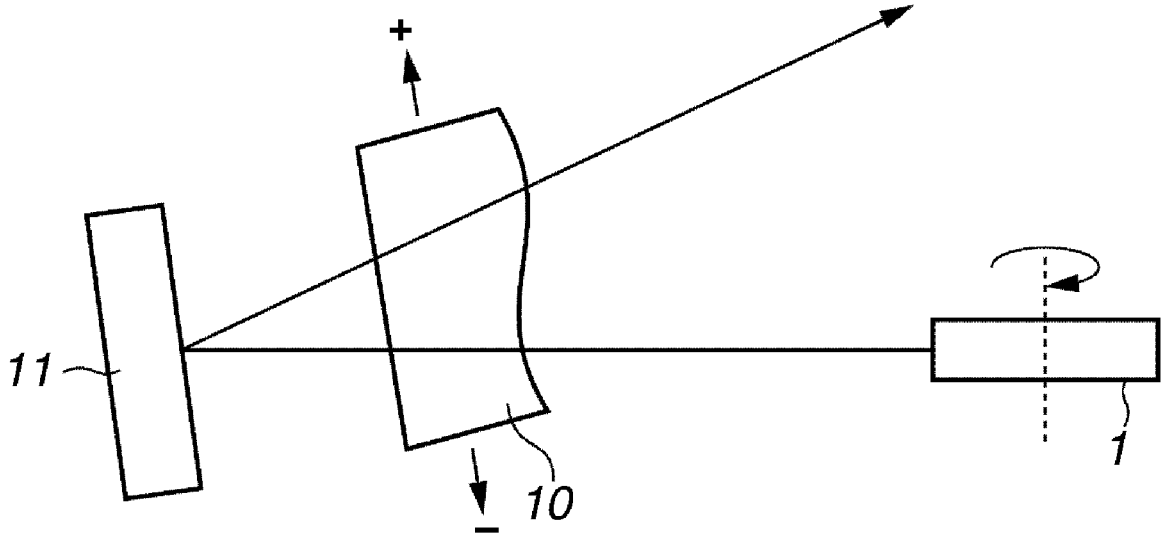
FIG. 19 is a cross-sectional diagram of the optical system illustrated in FIG. 18.

FIG. 18 is a diagram illustrating an example of the optical system having a large change in partial magnification caused by inclination correction. FIG. 19 is a cross-sectional diagram of the optical system illustrated in FIG. 18. This optical system includes a combined optical system of the first imaging lens and the second imaging lens as illustrated in FIGS. 18 and 19. This optical system is used in such a way that a laser beam deflected and scanned by the polygonal mirror 1 is reflected at a narrow angle by a folding mirror 11. By using a lens 10 that is integrally formed with the two imaging lenses, an image is formed with the scanning beam on the photosensitive drum 7 as well as the scanning beam is converted into a constant-speed scanning beam.

To correct an inclination of a scanning line, the motor 201 for correcting an inclination is used to turn one side of the lens 10 in the arrow direction (+ or −). The broken line in FIG. 18 indicates the center of rotation. In an optical system like this, since it is difficult to move a specific lens surface independently, a change in partial magnification is likely to be generated. For this reason, in such an optical system, the present invention is very effective.

With regard to the flow of the color misregistration correction process, a determination to carry out a correction process can be made based on an amount of temperature change or a number of sheets printed. Further, it may be determined based on both the amount of temperature change and the number of sheets printed. For example, an amount of temperature change exceeding a predetermined threshold value and the number of sheets printed exceeding a predetermined number of sheets can be used as a condition for executing the correction process.

In the exemplary embodiments described above, a residual amount of deviation is estimated based on an amount of driving of the motor, which is used to perform inclination correction. However, the arithmetic unit 203 can calculate a residual amount deviation directly from a read value of a pattern formed to correct color misregistration in the main body of the image forming apparatus.

With regard to the reading sensors, the number of them is not necessarily limited to two, and it can be more than two. The correction process can be performed by using the methods described above during a normal operation. Furthermore, by measuring estimation errors by detecting an amount of positional deviation with the reading sensors at intervals, and by reflecting measured values in the correction profile, the stability of control can be improved.

The present invention is not limited to scanning optical apparatuses and image forming apparatuses described in the above exemplary embodiments. For example, the present invention can be applied even if the optical parts are installed in an arrangement different from the above description and used in different numbers.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-313946 filed Dec. 4, 2007, which is hereby incorporated by reference herein in its entirety.

What is claimed is:

1. An image forming apparatus comprising:

an image bearing member configured to bear an image;

an exposure unit configured to draw a scanning line on the image bearing member by exposing the image bearing member according to image data;

at least two detection units configured to detect an amount of deviation in exposing position due to the exposure unit;

a drive unit configured to drive an optical part located on an optical path extending from the exposure unit to the image bearing member to reduce the amount of deviation detected by the detection units;

a measurement unit configured to measure an amount of driving of the driving unit;

an estimation unit configured to estimate a residual amount of deviation based on the amount of driving measured by the measurement unit; and a modulation unit configured to modulate a frequency of an image clock in the exposure unit to reduce the estimated residual amount of deviation.

2. The image forming apparatus according to claim 1, wherein the drive unit includes an inclination correction unit configured to correct inclination of the scanning line, which is one of a plurality of components constituting the amount of deviation, by driving the optical part.

3. The image forming apparatus according to claim 2, wherein the modulation unit includes a curvature component correcting unit configured to correct a curvature component, which is a residual amount of deviation remaining uncorrected by the inclination correction unit.

4. The image forming apparatus according to claim 3, wherein the curvature component includes a component generated by partial magnification being different according to an image height along a main scanning direction.

5. The image forming apparatus according to claim 4, wherein the drive unit includes a motor configured to drive an imaging lens in a plurality of optical parts.

6. The image forming apparatus according to claim 1, wherein the optical part includes a folding mirror curved by a force applied from a longitudinal direction thereof, wherein the image forming apparatus further comprises a storage unit configured to store a curvature amount of the folding mirror, and wherein the estimation unit is configured to estimate the residual amount of deviation based on the curvature amount stored in the storage unit and the amount of driving of the drive unit.

7. The image forming apparatus according to claim 1, further comprising:

a pattern forming unit configured to form a pattern to be used by the detection unit to detect the amount of deviation in exposing position due to the exposure unit;

a temperature measurement unit configured to measure temperature in the image forming apparatus;

a temperature calculation unit configured to calculate an amount of temperature change;

a first determination unit configured to determine whether the amount of temperature change has exceeded a predetermined threshold value, wherein the pattern forming unit is configured to form the pattern to be used to correct the amount of deviation when the amount of temperature change has exceeded the predetermined threshold value.

8. The image forming apparatus according to claim 7, further comprising:

a counting unit configured to count the number of printed sheets; and a second determination unit configured to determine whether the number of printed sheets has exceeded a predetermined number, wherein the pattern forming unit is configured to form the pattern to be used to correct the amount of deviation when the number of printed sheets has exceeded the predetermined number.

* * * * *